US012428766B2

(12) United States Patent
Jo et al.

(10) Patent No.: US 12,428,766 B2
(45) Date of Patent: Sep. 30, 2025

(54) WASHING MACHINE

(71) Applicant: SAMSUNG ELECTRONICS CO., LTD., Suwon-si (KR)

(72) Inventors: Youngchul Jo, Suwon-si (KR); Heejin Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 217 days.

(21) Appl. No.: 18/324,905

(22) Filed: May 26, 2023

(65) Prior Publication Data

US 2023/0295852 A1 Sep. 21, 2023

Related U.S. Application Data

(63) Continuation of application No. PCT/KR2022/001458, filed on Jan. 27, 2022.

(30) Foreign Application Priority Data

Feb. 10, 2021 (KR) ..... 10-2021-0019026
May 28, 2021 (KR) ..... 10-2021-0068888

(51) Int. Cl.
*D06F 17/10* (2006.01)
*D06F 37/12* (2006.01)
*D06F 39/08* (2006.01)

(52) U.S. Cl.
CPC ..... *D06F 17/10* (2013.01); *D06F 37/12* (2013.01); *D06F 39/083* (2013.01)

(58) Field of Classification Search
CPC ..... D06F 17/10; D06F 37/12; D06F 39/083; D06F 13/02; B01F 27/92
USPC ..... 68/134
See application file for complete search history.

(56) References Cited

U.S. PATENT DOCUMENTS 2,976,711 A * 3/1961 Smith ..... D06F 39/024 68/53
3,314,253 A * 4/1967 Smith ..... D06F 13/00 68/53
3,330,135 A * 7/1967 Douglas ..... D06F 13/00 68/17 A (Continued)

FOREIGN PATENT DOCUMENTS

CN 105133245 A * 12/2015
CN 204898347 U * 12/2015

(Continued)

OTHER PUBLICATIONS

International Search Report and Written Opinion of the International Searching Authority dated May 18, 2022, in connection with International Application No. PCT/KR2022/001458, 9 pages.

*Primary Examiner* — Michael E Barr
*Assistant Examiner* — Thomas Bucci

(57) ABSTRACT

Disclosed is a washing machine having an improved structure of a pulsator. The washing machine includes a tub, a rotating tub rotatably provided in the tub, a pulsator provided in the rotating tub to generate a wash water flow, and an agitator coupled to the pulsator and provided to generate a water flow by rubbing laundry and water, and a discharge provided at a coupler of the pulsator and the agitator so that foreign substances or water inside the pulsator and the agitator are discharged.

16 Claims, 13 Drawing Sheets

(56) References Cited

U.S. PATENT DOCUMENTS

| | | | | | |
|---|---|---|---|---|---|
| 3,381,505 | A * | 5/1968 | Smith | D06F 13/00 | 68/53 |
| 4,077,239 | A * | 3/1978 | Platt | D06F 13/02 | 68/184 |
| 4,338,802 | A * | 7/1982 | Ohmann | D06F 39/10 | 415/121.2 |
| 4,691,538 | A * | 9/1987 | Shikamori | D06F 13/02 | 68/12.18 |
| 5,611,221 | A * | 3/1997 | Tremel | D06F 17/08 | 68/133 |
| 6,818,923 | B2 | 11/2004 | Kim et al. | | |
| 9,777,418 | B2 * | 10/2017 | Carr | D06F 17/10 | |
| 9,896,792 | B2 | 2/2018 | Erickson | | |
| 11,655,580 | B2 * | 5/2023 | Rangu | D06F 17/10 | 68/4 |
| 2003/0200774 | A1 * | 10/2003 | Kim | D06F 17/06 | 68/132 |
| 2004/0016267 | A1 * | 1/2004 | Clark | D06F 13/02 | 68/133 |
| 2017/0073868 | A1 * | 3/2017 | Lv | D06F 17/10 | |
| 2019/0062978 | A1 * | 2/2019 | Czarnecki | D06F 31/00 | |
| 2021/0062382 | A1 * | 3/2021 | Andrejczuk | D06F 17/10 | |
| 2023/0002949 | A1 * | 1/2023 | Rangu | D06F 17/10 | |
| 2024/0035226 | A1 * | 2/2024 | Attar | B01D 35/02 | |

FOREIGN PATENT DOCUMENTS

| | | | | |
|---|---|---|---|---|
| JP | S-59129096 | A | 7/1984 | |
| KR | 10-1988-0001643 | B1 | 9/1988 | |
| KR | 20-1996-0005144 | U | 7/1994 | |
| KR | 20-0124291 | Y1 | 6/1998 | |
| KR | 10-2000-0009966 | A | 2/2000 | |
| KR | 10-2020-000009523 | U | 6/2000 | |
| KR | 20-0204132 | Y1 | 9/2000 | |
| KR | 10-2001-0003127 | A | 1/2001 | |
| KR | 10-2001-0003134 | A | 1/2001 | |
| KR | 10-0296801 | B1 | 10/2001 | |
| KR | 10-2002-0006803 | A | 1/2002 | |
| KR | 10-2005-0050269 | A | 5/2005 | |
| KR | 10-0646888 | B1 | 11/2006 | |
| KR | 10-0740833 | B1 | 7/2007 | |
| KR | 10-0766037 | B1 | 10/2007 | |
| KR | 10-2011-0009536 | A | 1/2011 | |
| KR | 10-1015244 | B1 | 2/2011 | |
| KR | 10-1716192 | B1 | 3/2017 | |
| WO | WO-2018108076 | A1 * | 6/2018 | D06F 17/06 |

* cited by examiner

WASHING MACHINE

CROSS-REFERENCE TO RELATED APPLICATIONS

This application is a bypass continuation of International Patent Application No. PCT/KR2022/001458, filed on Jan. 27, 2022, which claims priority to Korean Patent Application No. 10-2021-0019026, filed on Feb. 10, 2021, and Korean Patent Application No. 10-2021-0068888, filed on May 28, 2021, in the Korean Intellectual Property Office, the disclosure of which is incorporated by reference herein in its entirety.

BACKGROUND

1. Field

The disclosure relates to a washing machine, and more particularly, to a washing machine having an improved structure of a pulsator.

2. Description of Related Art

A washing machine is a device that uses the driving force of a motor to agitate laundry, wash water, and detergent put into a drum so that washing is performed through mutual friction.

In general, in a washing machine, a pulsator-type washing machine that performs washing by rotating wash water and laundry with a pulsator rotatably installed on the bottom inside a water tank, an agitator-type washing machine that performs washing by stirring wash water and laundry with an agitator protruding from the center of a water tank, and a drum washing machine that performs washing while repeatedly raising and lowering laundry by rotating a drum containing the laundry.

In addition, the washing machine includes a tub for storing water and a rotating tub rotatably installed inside the tub. A pulsator is installed at the bottom of the rotating tub to form a water stream while rotating. The pulsator rotates in the forward and reverse directions to form a water flow, and the water flow generated by the pulsator stirs and rotates the wash water and the laundry, thereby washing the laundry.

Recently, research on a structure for improving washing power by adding complexity to the flow of laundry has been conducted.

SUMMARY

Therefore, it is an aspect of the disclosure to provide a washing machine having an improved structure of a pulsator.

It is another aspect of the disclosure to provide a washing machine with an improved coupling structure between a pulsator and an agitator.

It is another aspect of the disclosure to provide a washing machine in which a discharge flow path is provided at a coupler between a pulsator and an agitator to remove water and foreign substances.

Additional aspects of the disclosure will be set forth in part in the description which follows and, in part, will be obvious from the description, or may be learned by practice of the disclosure.

In accordance with an aspect of the disclosure, a washing machine includes a tub; a rotating tub rotatably provided in the tub; a pulsator provided in the rotating tub, and configured to generate wash water flow; and an agitator coupled to the pulsator and configured to generate water flow by rubbing laundry and water; and a discharge provided in the coupler of the pulsator and the agitator so that foreign substances or water inside the pulsator and the agitator are discharged.

The discharge comprises a first discharge hole formed in at least a part of the pulsator, and a second discharge hole formed in at least a part of the agitator.

The first discharge hole and the second discharge hole are provided at positions corresponding to each other.

The first discharge hole and the second discharge hole are provided in a plurality, respectively.

The coupler includes a first coupler provided at the center of the pulsator, and a second coupler provided at a lower of the agitator to correspond to the first coupler.

The first discharge hole is provided in the first coupler, and the second discharge hole is provided in the second coupler.

The first coupler includes a coupling groove body formed in a cylindrical shape at a center of a upper surface of the pulsator, and at least one coupling groove recessed from a bottom of the coupling groove body.

The coupling grooves are spaced apart from each other in a circumferential direction of the coupling groove body.

The first discharge hole is formed in at least a part of the coupling groove.

The second coupler includes a coupling protrusion body formed at a lower end of the agitator to correspond to the coupling groove body, and at least one coupling protrusion protruding from a lower end of the coupling protrusion body to correspond to the coupling groove.

The second discharge hole is formed on at least a part of the coupling protrusion.

The second discharge hole is positioned at a bottom of the coupling protrusion.

The discharge further includes a discharge flow path formed to discharge water and foreign substances inside the agitator, the first discharge hole and the second discharge hole are positioned in the discharge flow path.

The discharge flow path formed between inside of the agitator or the pulsator and outside of the pulsator.

In accordance with another aspect, a washing machine comprises a rotary tub configured to accommodate laundry; a pulsator rotatably provided in the rotating tub, wherein the pulsator is rotatably coupled with a first part rotatably provided at a lower portion of the rotating tub and about an axis perpendicular to the first part and a second part, a coupler provided to correspond to the first part and the second part so that the first part and the second part are coupled, and a discharge hole provided in the coupler to discharge foreign substances and water inside the pulsator through the coupler.

The discharge hole includes a first discharge hole formed in at least a portion of the first part, and a second discharge hole formed in at least a portion of the second part.

The first discharge hole and the second discharge hole are positioned to correspond to each other.

The coupler includes a first coupler provided on the first part and a second coupler provided on the second part to correspond to the first coupler.

The first discharge hole is formed in the first coupler, and the second discharge hole is formed in the second coupler.

A plurality of the first discharge hole and the second discharge hole are positioned to correspond to each other.

The discharge hole further includes a discharge flow path formed to discharge water and foreign substances inside the pulsator, and the first discharge hole and the second discharge hole are positioned on the discharge flow path.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
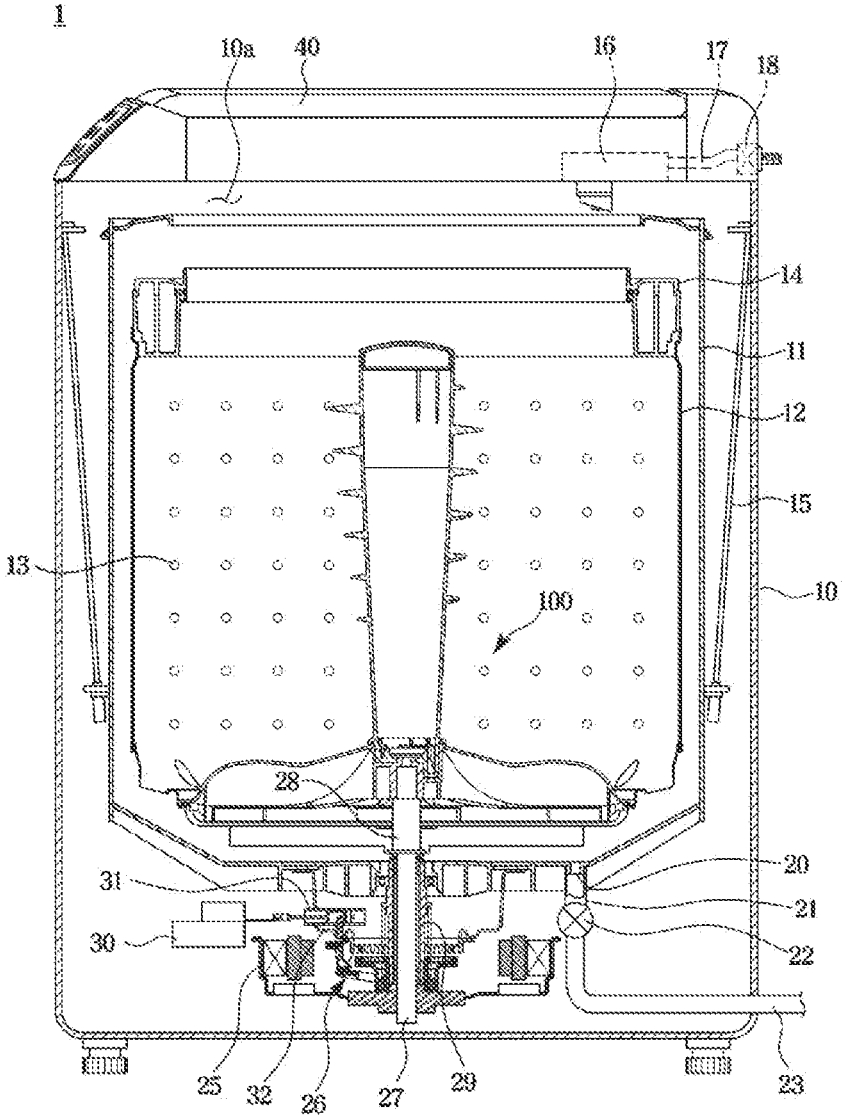
FIG. 1 is a cross-sectional view of a washing machine according to an embodiment of the present disclosure.

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "rear", "left", "right", and the like may be defined by the drawings, but the shape and the location of the component is not limited by the term.

The disclosure will be described more fully hereinafter with reference to the accompanying drawings.

Figure 2:
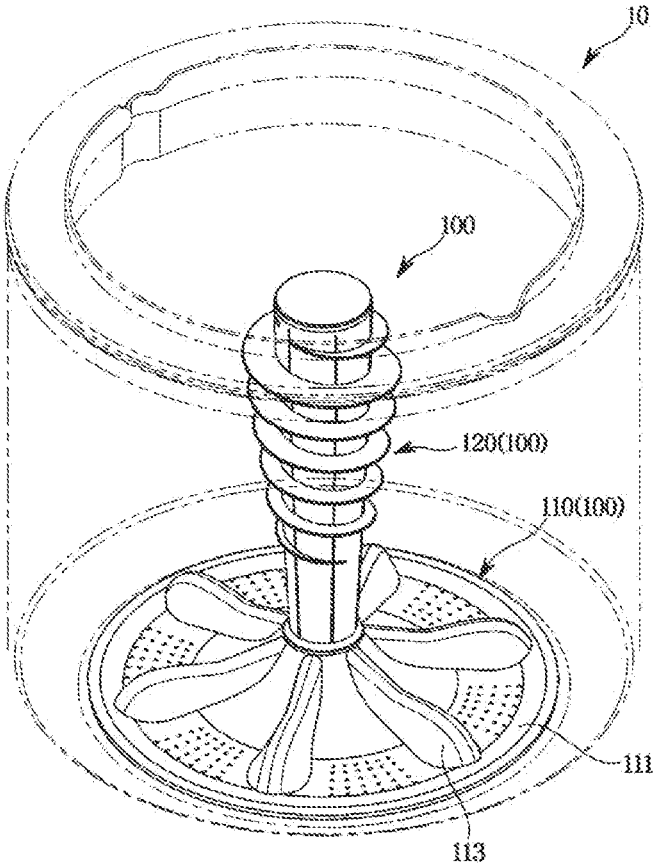
FIG. 2 is a perspective view showing the internal structure of a washing machine according to an embodiment of the present disclosure.

FIG. 1 is a cross-sectional view of a washing machine according to an embodiment of the present disclosure, and FIG. 2 is a perspective view showing the internal structure of a washing machine according to an embodiment of the present disclosure.

As illustrated in FIGS. 1 and 2, a washing machine 1 includes a cabinet 10 forming an exterior, a tub 11 disposed inside the cabinet 10 to store wash water, a rotating tub 12 rotatably disposed in the tub 12, and a pulsator 100 disposed inside the rotating tub 12 to generate a water flow.

The cabinet 10 forms the exterior of the washing machine 1 and is formed in a substantially rectangular parallelepiped shape. An input port 10*a* is formed at an upper portion of the cabinet 10 to input laundry into the rotary tub 12. A door capable of opening and closing the input port 10*a* may be provided on the upper surface of the cabinet 10. The input port 10*a* may be opened and closed by a door 40 installed on the top of the cabinet 10.

The tub 11 is vertically installed inside the cabinet 10. The tub 11 is formed in a substantially hollow cylindrical shape with a bottom to accommodate a certain amount of wash water. The tub 11 may be supported on the cabinet 10 by a suspension device 15. Vibrations generated in the tub 11 may be damped by the suspension device 15.

A water supply pipe 17 for supplying wash water to the tub 11 is installed above the tub 11. One side of the water supply pipe 17 is connected to an external water supply source, and the other side of the water supply pipe 17 is connected to a detergent supply device 16. Water supplied through the water supply pipe 17 is supplied to the inside of the tub 11 together with detergent via the detergent supply device 16. A water supply valve 18 is installed in the water supply pipe 17 to control the supply of water.

The rotating tub 12 is formed in a substantially hollow cylindrical shape with a bottom and is rotatably installed inside the tub 11. The rotating tub 12 is provided in a cylindrical shape with an open top, and a plurality of dewatering holes 13 are formed on the side thereof. A balancer 14 may be mounted on the top of the rotating tub 12 so that the rotating tub 12 may stably rotate at high speed.

On the outside of the lower side of the tub 11, a motor 25 that generates driving force for rotating the rotating tub 12 and the pulsator 100, and a power converter 26 is installed to simultaneously or selectively transfer the driving force generated from the motor 25 to the rotating tub 12 and the pulsator 100.

A hollow dehydration shaft 29 is coupled to the rotating tub 12, and a washing shaft 27 installed in the hollow of the dehydration shaft 29 is coupled to the pulsator 100 through a washing shaft coupler 28. The motor 25 may simultaneously or selectively transmit driving force to the rotating tub 12 and the pulsator 100 according to the lifting operation of the power converter 26.

The power converter 26 is configured to include an actuator 30 that generates a driving force for power conversion, a rod part 31 that moves linearly according to the operation of the actuator 30, a clutch part 32 that rotates according to the operation of the rod part 31.

A drain hole 20 is formed at the bottom of the tub 11 to discharge wash water stored in the tub 11, and a first drainpipe 21 is connected to the drain hole 20. A drain valve 22 may be installed in the first drainpipe 21 to control drain. An outlet of the drain valve 22 may be connected to a second drainpipe 23 for discharging wash water to the outside.

The rotating tub 12 may be rotatably provided inside the tub 11. The rotating tub 12 may be formed in a substantially cylindrical shape with an open upper surface. The rotating tub 12 may be arranged such that its central axis coincides with the central axis of the tub 11.

A pulsator 100 may be rotatably provided on the inner bottom of the rotating tub 12. The pulsator 100 is rotatably installed on the lower side of the inside of the rotating tub 12, and agitates the laundry put into the rotating tub 12 together with the wash water and generates a water flow so that the laundry in the rotating tub 12 is washed by friction.

Figure 3:
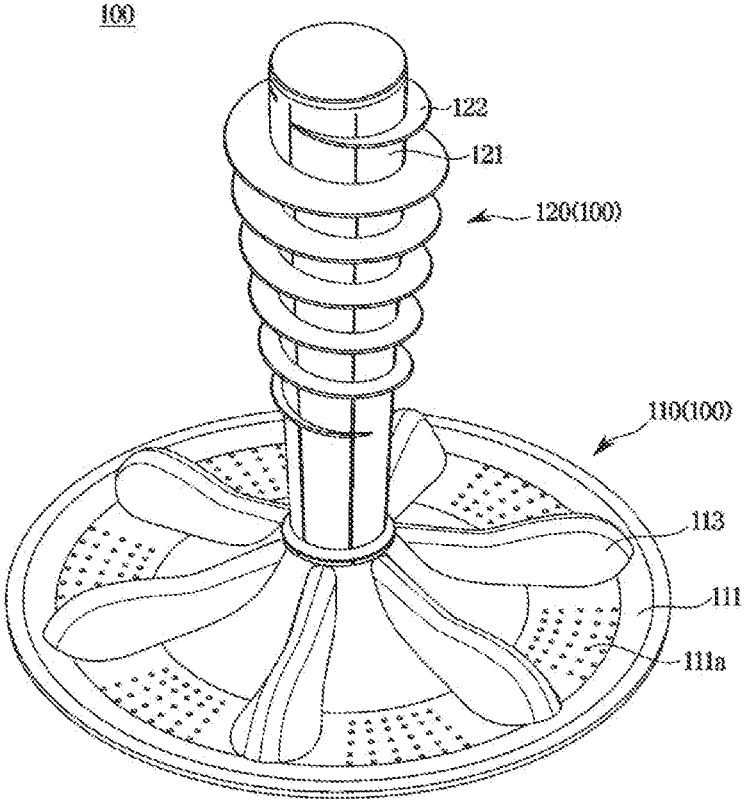
FIG. 3 is a perspective view showing a pulsator according to an embodiment of the present disclosure.
Figure 4:
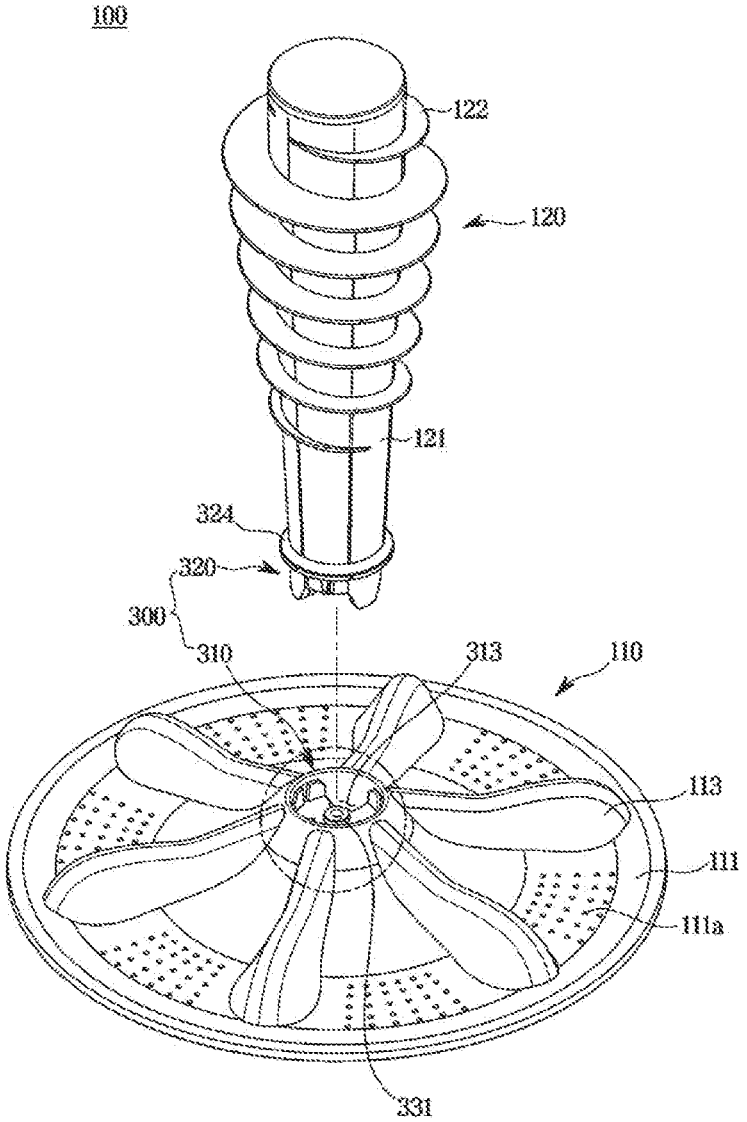
FIG. 4 is an exploded perspective view showing a coupler of a pulsator according to an embodiment of the present disclosure.

FIG. 3 is a perspective view showing a pulsator according to an embodiment of the present disclosure; FIG. 4 is an exploded perspective view showing a coupler of a pulsator according to an embodiment of the present disclosure; and FIG. 5 is a partially exploded perspective view showing the bottom of a pulsator according to an embodiment of the present disclosure.

Figure 5:
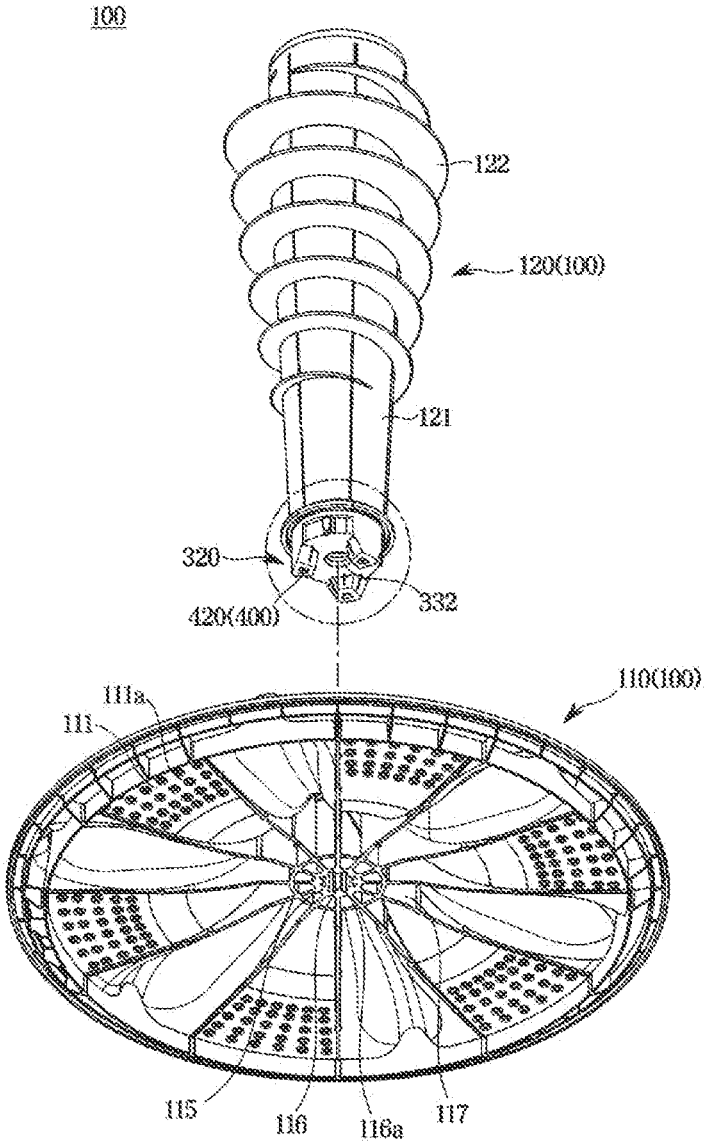
FIG. 5 is a partially exploded perspective view showing the bottom of a pulsator according to an embodiment of the present disclosure.

As illustrated in FIGS. 3 to 5, the pulsator 100 is configured to rotate forward and backward in the rotating tub 12 to generate a water flow, and laundry in the rotating tub 12 is agitated by the water flow generated by the pulsator 100 and washed.

The pulsator 100 may include a first part 110 formed in a substantially disc shape, and a second part 120 coupled to the first part 110 and rotatably provided.

The first part 110 of the pulsator is provided at the bottom of the rotating tub 12 to generate wash water flow, and the second part 120 is coupled upright to the center of the first part 110 to generate a water flow by rubbing laundry and washing water (water).

Hereinafter, the second part 120 coupled to the first part 110 of the pulsator 100 and extending vertically upward will be referred to as an agitator.

The first part 110 of the pulsator 100 may include a pulsator body 111 and at least one body blade 113 protruding from the upper surface of the pulsator body 111. The pulsator body 111 may be formed in a disk shape. The pulsator body 111 is rotatably installed on the inner lower surface of the rotating tub 12. A plurality of holes 111*a* may be formed in the pulsator body 111. The plurality of holes 111*a* may be formed around the circumferential direction of the pulsator body 111. Wash water may move to the outside of the pulsator 100 through the plurality of holes 111*a*.

The body blades 113 formed on the upper surface of the pulsator body 111 are formed in the same shape, and may be spaced apart at regular intervals in the circumferential direction of the pulsator body 111.

The pulsator body 111 may be provided with a shaft coupling boss 115 having a shaft coupling groove 116 so that the washing shaft coupler 28 of the washing shaft 27 may be fitted. The shaft coupling boss 115 may be formed on the central rear surface of the pulsator body 111. The shaft coupling boss 115 is formed in a hollow cylindrical shape, and the shaft coupling groove 116 having a plurality of spline grooves 116*a* is provided on an inner circumferential surface thereof.

A plurality of ribs 117 extending radially around the shaft coupling boss 115 may be provided on the rear surface of the pulsator body 111. The plurality of ribs 117 formed on the pulsator body 111 may be provided to function as an impeller.

A coupler 300 for coupling the second part 120 of the pulsator 100, that is, the agitator 120, may be provided at the center of the upper surface of the pulsator body 111. The coupler 300 will be described in detail below.

The agitator 120 of the pulsator 100 may include an agitator body 121 formed in a substantially cylindrical shape and an agitator blade 122 protruding from an outer circumferential surface of the agitator body 121.

The agitator body 121 may be coupled to the first part 110 and rotatably installed inside the rotating tub 12. The agitator body 121 may be installed vertically from the center of the first part 110. The agitator body 121 rotates inside the rotary tub 12 and rubs the laundry mixed with the washing water to perform washing.

The agitator blade 122 protrudes around the outer circumferential surface of the agitator body 121 and may be provided to improve friction of laundry.

The coupler 300 may be provided below the agitator 120 to be coupled with the first part 110. The agitator 120 of the pulsator 100 and the first part 110 may be coupled through the coupler 300.

The pulsator 100 may include the coupler 300 provided to couple the first part 110 and the agitator 120.

The coupler 300 may include a first coupler 310 provided on the first part 110 and a second coupler 320 provided on the agitator 120 to correspond to the first coupler 310.

The first coupler 310 may be formed at the center of the first part 110 of the pulsator 100. The second coupler 320 is formed at the lower end of the agitator 120 and is formed in a shape corresponding to the first coupler 310.

The coupler 300 for coupling the first part 110 of the pulsator 100 and the agitator 120 is provided with a discharge 400 formed to discharge foreign substances and washing water inside the pulsator 100 and the agitator 120.

The discharge 400 may be provided to discharge foreign substances and wash water introduced into the pulsator 100. The discharge 400 may be located at the coupler 300 of the first part 110 and the second part 120 of the pulsator 100.

Figure 6:
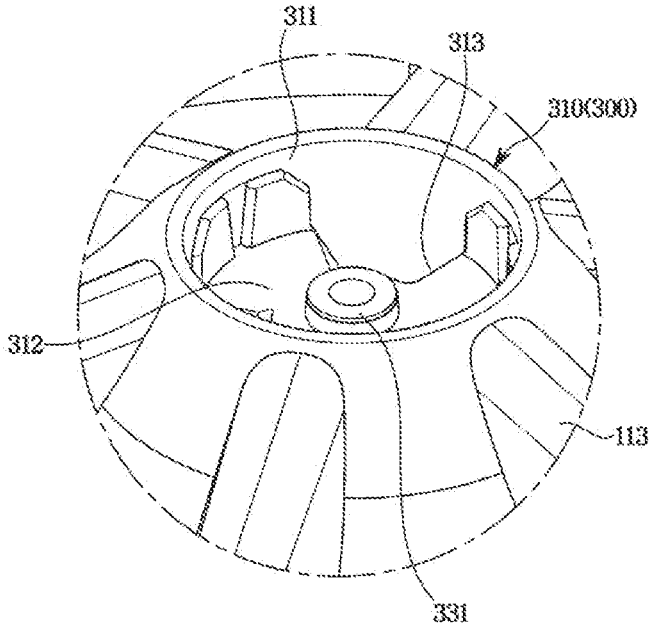
FIG. 6 is an enlarged view of part A of FIG. 3.
Figure 7:
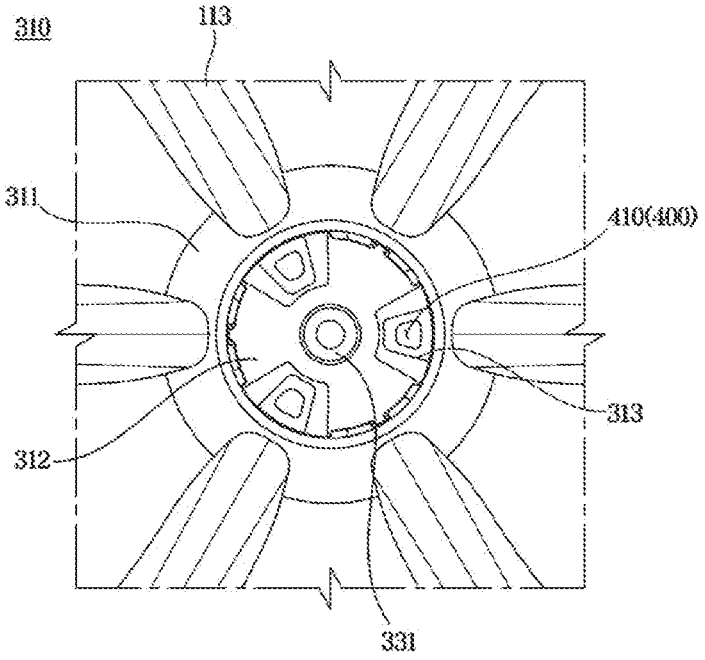
FIG. 7 is a view showing a discharge provided in a coupler of a pulsator according to an embodiment of the present disclosure.
Figure 8:
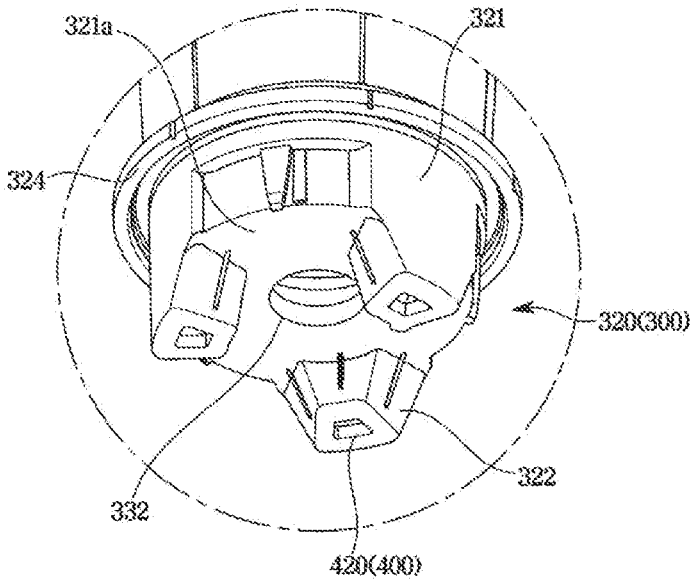
FIG. 8 is an enlarged view of part B of FIG. 5.
Figure 9:
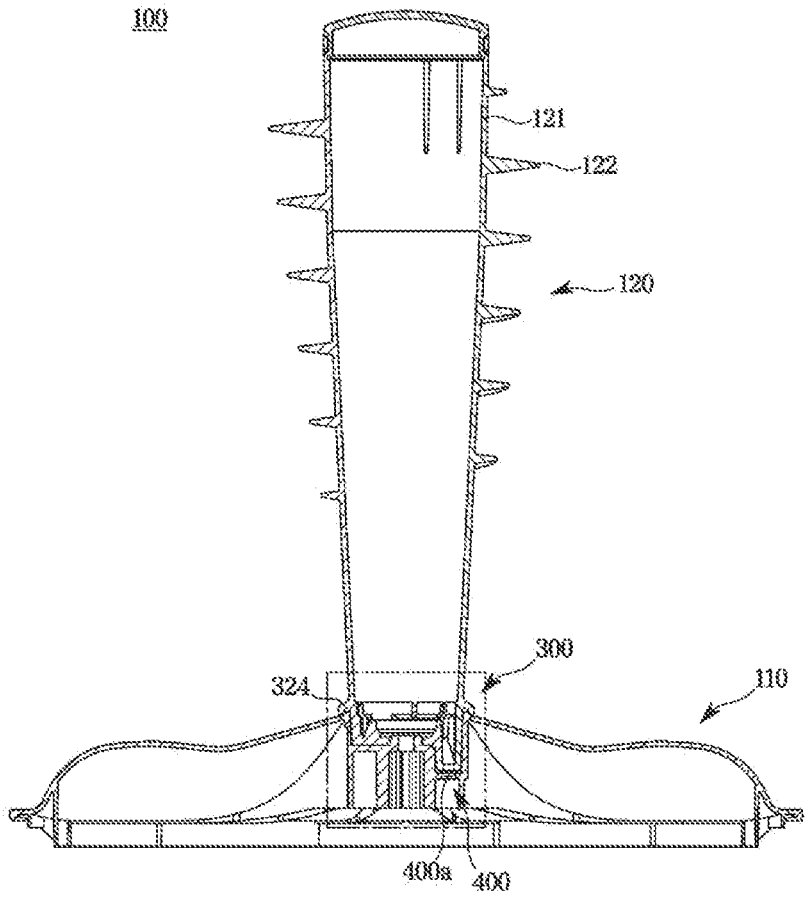
FIG. 9 is a cross-sectional view of a pulsator according to an embodiment of the present disclosure.
Figure 10:
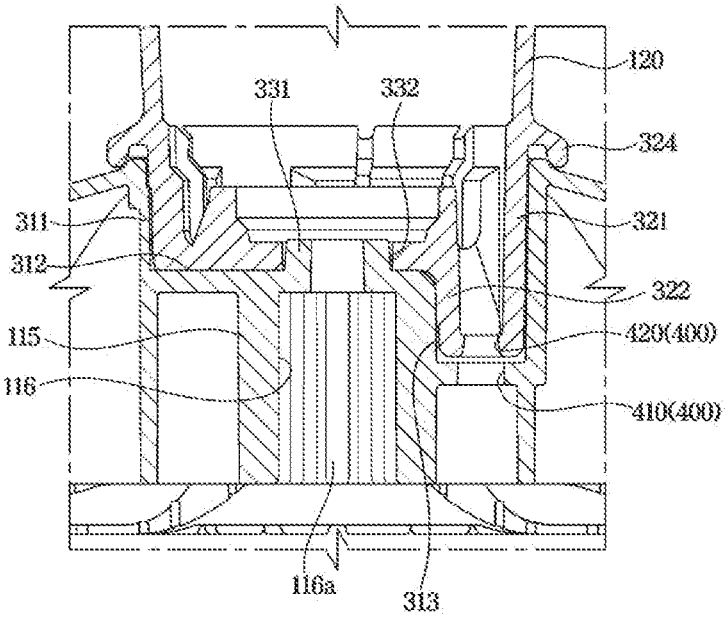
FIG. 10 is an enlarged view of part C of FIG. 8.

FIG. 6 is an enlarged view of part A of FIG. 3; FIG. 7 is a view showing a discharge provided in a coupler of a pulsator according to an embodiment of the present disclosure; FIG. 8 is an enlarged view of part B of FIG. 5; FIG. 9 is a cross-sectional view of a pulsator according to an embodiment of the present disclosure; FIG. 10 is an enlarged view of part C of FIG. 8;

As illustrated in FIGS. 6 to 10, the pulsator 100 may include a discharge 400 formed at the coupler 300 of the first part 110 and the agitator 120.

The coupler 300 of the pulsator 100 may include the first coupler 310 provided on the first part 110 of the pulsator 100, and the second coupler 320 provided in the lower end of the agitator 120 to correspond to the first coupler 310.

The first coupler 310 may be formed at the center of the upper surface of the first part 110. The first coupler 310 may include a coupling groove body 311 formed to be recessed in a cylindrical shape at the center of the upper surface of the pulsator body 111, and a coupling groove 313 formed to be recessed from the bottom of the coupling groove body 311.

The coupling groove body 311 of the first coupler 310 may be formed in a substantially cylindrical shape. The coupling groove body 311 may have a circular bottom 312 and an open upper surface. A plurality of coupling grooves 313 may be formed on the bottom 312 of the coupling groove body 311. The plurality of coupling grooves 313 may be spaced apart from each other in the circumferential direction of the coupling groove body 311. The plurality of coupling grooves 313 may be formed as three coupling grooves spaced apart around a circle of the coupling groove body 311. In the embodiment of the present disclosure, three coupling grooves are formed as an example, the concept of the present disclosure is not limited thereto. For example, the number of coupling grooves may be changed by the size of the pulsator or agitator.

The first coupler 310 may further include a guide protrusion 331 protruding from the center of the bottom 312 of the coupling groove body 311. The guide protrusion 331 of the first coupler 310 may be provided to be connected to the shaft coupling boss 115 formed on the rear surface of the coupling groove body 311. The guide protrusion 331 may be formed to extend from the shaft coupling boss 115.

The guide protrusion 331 of the first coupler 310 may be provided to correspond to a guide hole 332 of the second coupler 320 to be described below. The guide protrusion 331 of the first coupler 310 may be provided to be inserted into the guide hole 332 of the second coupler 320. The guide protrusion 331 may have a size and shape corresponding to the guide hole 332. The guide protrusion 331 and the guide hole 332 may be configured to guide coupling between the first coupler 310 and the second coupler 320.

The second coupler 320 may be provided to correspond to the first coupler 310. The second coupler 320 includes a coupling protrusion body 321 formed at the bottom of the agitator 120 to correspond to the coupling groove body 311 and a coupling protrusion 322 protruding to the bottom from the coupling protrusion body 321 to correspond to the coupling groove 313.

The coupling protrusion body 321 of the second coupler 320 may be formed in a substantially cylindrical shape. The coupling protrusion body 321 may be integrally formed with the lower end of the agitator 120. The coupling protrusion body 321 has a circular bottom surface 321*a*, and a plurality of coupling protrusions 322 may be formed on the bottom surface 321*a* of the coupling protrusion body 321. The plurality of coupling protrusions 322 may be spaced apart from each other in a circumferential direction of the coupling protrusion body 321. The plurality of coupling protrusions 322 may be formed as three coupling protrusions spaced apart from each other around the circle of the coupling protrusion body 321. The coupling protrusion 322 may be formed to correspond to the coupling groove 313 of the first coupler 310.

The second coupler 320 may further include a guide hole 332 formed at the center of the bottom surface 321*a* of the coupling protrusion body 321. The guide hole 332 of the second coupler 320 may be provided to correspond to the guide protrusion 331 of the first coupler 310. The guide hole 332 may be formed in a size and shape corresponding to the guide protrusion. The guide hole 332 is guided by the guide protrusion 331 to guide the coupling of the first coupler 310 and the second coupler 320.

The second coupler 320 is provided below the agitator 120, and the agitator 120 further includes a support rib 324 to support the coupling between the second coupler 320 and the first coupler 310. The support rib 324 may be provided on an outer circumferential surface of the agitator body 121. The support rib 324 may be formed to extend from the outer circumferential surface of the agitator body 121. The support rib 324 may be formed to correspond to the upper opening of the coupling groove body 311 of the first coupler 310.

The coupler 300 of the pulsator 100 may be provided with a discharge 400 to discharge foreign substances and wash water introduced into the pulsator 100 and the agitator 120.

The discharge 400 may be formed on at least a part of the first part 110 and the second part 120 of the pulsator 100. The discharge 400 may be formed on at least a part of the coupler 300 of the pulsator 100. The discharge 400 may be formed on the first coupler 310. The discharge 400 may be formed on the second coupler 320. The discharge 400 may further include at least one hole.

The discharge 400 may include a first discharge hole 410 formed on at least a part of the first part 110 and a second discharge hole 420 formed on at least a part of the agitator 120.

The first discharge hole 410 and the second discharge hole 420 of the discharge 400 may be formed at positions corresponding to each other. The first discharge hole 410 and the second discharge hole 420 may be formed to be communicated to each other.

The first discharge hole 410 of the discharge 400 may be formed in the first coupler 310 provided in the first part 110. The first discharge hole 410 may be formed in the coupling groove 313 of the first coupler 310. The first discharge hole 410 may be formed at the bottom of the coupling groove 313.

The second discharge hole 420 may be formed in the second coupler 320 provided in the agitator 120. The second discharge hole 420 may be formed on the coupling protrusion 322 of the second coupler 320. The second discharge hole 420 may be formed at the bottom of the coupling protrusion 322.

The first discharge hole 410 formed on the bottom of the coupling groove 313 of the first coupler 310 and the second discharge hole 420 formed on the bottom of the coupling protrusion 322 of the second coupler 320 are communicated to each other.

Foreign substances and wash water introduced into the pulsator 100 and the agitator 120 are discharged to the outside of the pulsator 100 and the agitator 120 through the first discharge hole 410 and the second discharge hole 420.

The discharge 400 may further include a discharge flow path 400*a* formed to discharge water and foreign substances inside the pulsator 100 or the agitator 120 to the outside of the pulsator 100 or the agitator 120. The first discharge hole 410 and the second discharge hole 420 may be positioned on the discharge flow path 400*a*. Water or foreign substances inside the pulsator 100 or the agitator 120 may be discharged to the outside of the pulsator 100 or the agitator 120 through the first discharge hole 410 and the second discharge hole 420.

Figure 11:
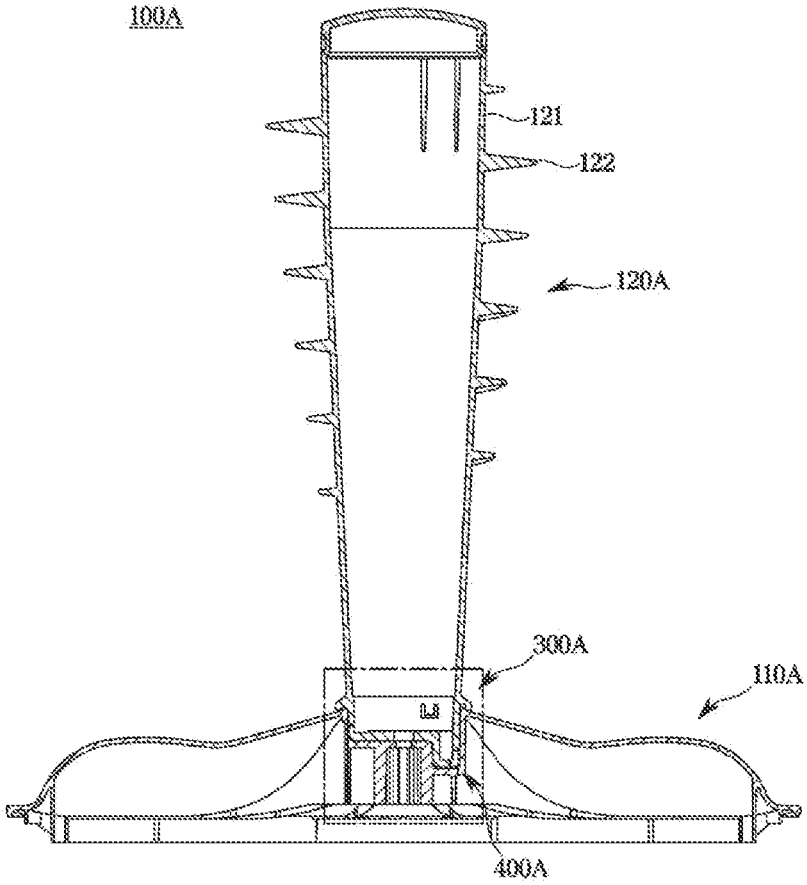
FIG. 11 is a cross-sectional view showing a pulsator of a washing machine according to another embodiment of the present disclosure.
Figure 12:
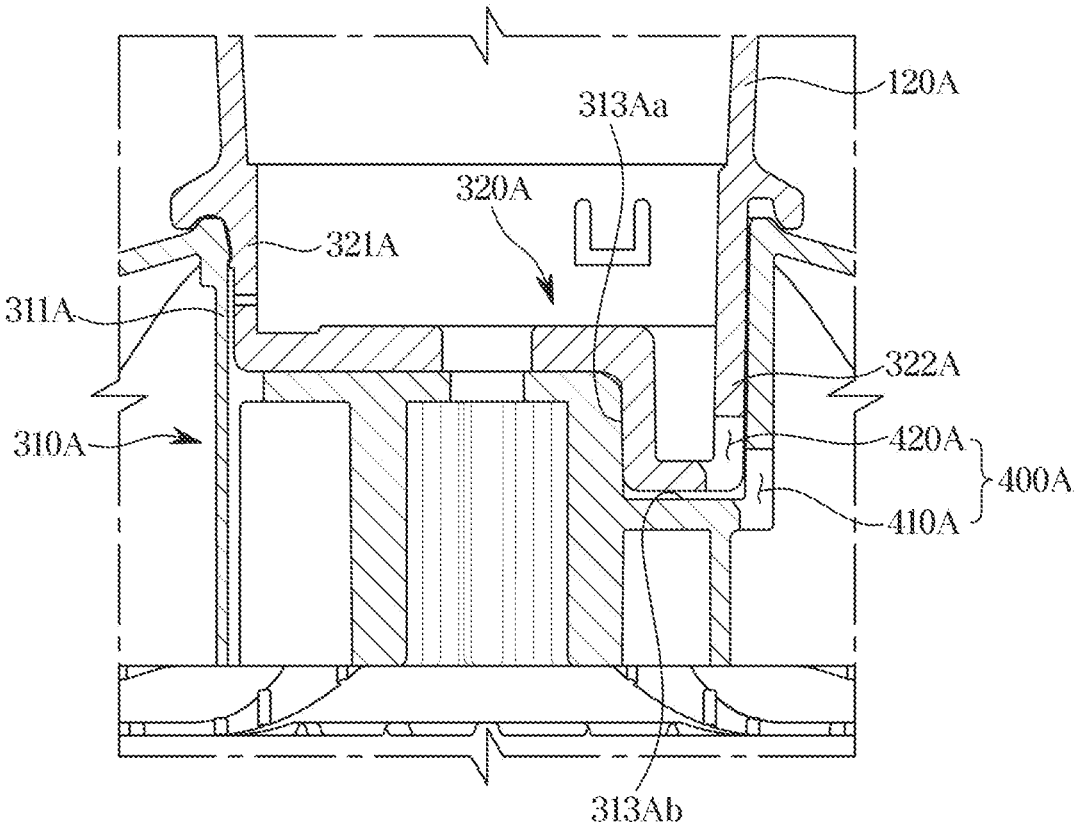
FIG. 12 is an enlarged view of part D of FIG. 11.
Figure 13:
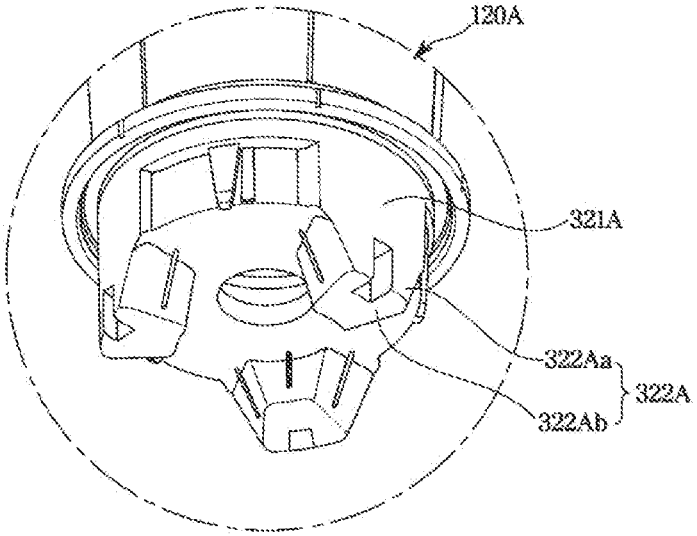
FIG. 13 is a view showing a discharge of a pulsator according to another embodiment of the present disclosure.

FIG. 11 is a cross-sectional view showing a pulsator of a washing machine according to another embodiment of the present disclosure; FIG. 12 is an enlarged view of part D of FIG. 11; FIG. 13 is a view showing a discharge of a pulsator according to another embodiment of the present disclosure.

As illustrated in FIGS. 11 to 13, a pulsator 100A has a first part 110A provided at the bottom of a rotating tub 12 to generate wash water flow, and a second part 120A coupled to a center of the first part 110A upright to generate water flow by rubbing laundry and wash water (water).

The pulsator 100A may further include a coupler 300A for coupling the first part 110A and the second part 120A. The coupler 300A may include a first coupler 310A provided on the first part 110A and a second coupler 320A provided on the second part 120A.

The coupler 300A of the first part 110A and the second part 120A may be provided with a discharge 400A to discharge foreign substances and washing water introduced into the pulsator 100A. The discharge 400A may include at least one or more holes.

The discharge 400A may include a first discharge hole 410A formed on at least a portion of the first part 110A and a second discharge hole 420A formed on at least a portion of the second part 120A.

The first discharge hole 410A and the second discharge hole 420A of the discharge 400A may be formed at positions corresponding to each other. The first discharge hole 410A and the second discharge hole 420A may be formed to be connected to each other.

The first discharge hole 410A of the discharge 400A may be formed in the first coupler 310A provided in the first part 110A. The first discharge hole 410A may be formed in a coupling groove 313A of the first coupler 310A. The first discharge hole 410A may be formed at a corner of the coupling groove 313A. The coupling groove 313A may include a coupling groove side surface 313Aa extending downward of the coupling groove body 311A and a coupling groove bottom surface 313Ab extending from the coupling groove side surface 313Aa. The first discharge hole 410A may be formed at a corner of the coupling groove 313A, that is, a connection portion between the coupling groove side surface 313Aa and the coupling groove bottom surface 313Ab.

The second discharge hole 420A may be formed in the second coupler 320A provided in the second part 120A. The second discharge hole 420A may be formed on a coupling protrusion 322A of the second coupler 320A. The second discharge hole 420A may be formed at a corner of the coupling protrusion 322A.

The coupling protrusion 322A may include a coupling protrusion side surface 322Aa extending downward from the coupling protrusion body 321A and a coupling protrusion bottom surface 322Ab extending from the coupling protrusion side surface 322Aa. The second discharge hole 420A may be formed at a corner of the coupling protrusion 322A, that is, at a connection between the coupling protrusion side surface 322Aa and the coupling protrusion bottom surface 322Ab. The second discharge hole 420A may be located at a position corresponding to the first discharge hole 410A.

The first discharge hole 410A formed on the coupling groove 313A of the first coupler 310A and the second discharge hole 420A formed on the coupling protrusion 322A of the second coupler 320A are communicated to each other.

Therefore, foreign substances and wash water introduced into the pulsator 100A are discharged to the outside of the pulsator 100A through the first discharge hole 410A and the second discharge hole 420A.

The pulsator of the present invention has the effect of improving washing power by improving the structure to generate washing water flow by friction between laundry and washing water.

In addition, a discharge channel for water and foreign matter is provided at the connection part of the pulsator and the agitator, which has the effect of preventing foreign matter and laundry water from remaining inside the pulsator.

In addition, it has the effect of improving the durability of the product by improving the coupling structure of the pulsator and the agitator.

Although a few embodiments of the disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a tub;

a rotating tub rotatably provided in the tub;

a pulsator provided in the rotating tub, and configured to generate wash water flow;

an agitator coupled to the pulsator and configured to generate water flow by rubbing laundry and water;

a first coupler including a coupling groove body formed in a cylindrical shape at a center of an upper surface of the pulsator;

one or more coupling grooves recessed from a bottom of the coupling groove body;

a second coupler including a coupling protrusion body formed at a lower end of the agitator to correspond to the coupling groove body; and one or more coupling protrusions protruding from a lower end of the coupling protrusion body to correspond to the one or more coupling grooves.

2. The washing machine of claim 1, further comprising:

a first discharge hole formed in at least a part of the pulsator, and a second discharge hole formed in at least a part of the agitator.

3. The washing machine of claim 2, wherein the first discharge hole and the second discharge hole are provided at positions corresponding to each other.

4. The washing machine of claim 3, wherein the first discharge hole and the second discharge hole are each provided in a plurality.

5. The washing machine of claim 3, wherein:

the first discharge hole is provided in the first coupler, and the second discharge hole is provided in the second coupler.

6. The washing machine of claim 1, wherein the one or more coupling grooves include at least two coupling grooves that are spaced apart from each other in a circumferential direction of the coupling groove body.

7. The washing machine of claim 2, wherein the first discharge hole is formed in at least a part of one of the one or more coupling grooves.

8. The washing machine of claim 2, wherein the second discharge hole is formed on at least a part of one of the one or more coupling protrusions.

9. The washing machine of claim 8, wherein the second discharge hole is positioned at a bottom of the one of the one or more coupling protrusions.

10. The washing machine of claim 2, further comprising:

a discharge flow path formed to discharge water and foreign substances inside the agitator, wherein the first discharge hole and the second discharge hole are positioned in the discharge flow path.

11. The washing machine of claim 10, wherein the discharge flow path is formed between an inside of the agitator or the pulsator and an outside of the pulsator.

12. A washing machine comprising:

a rotating tub configured to accommodate laundry;

a pulsator rotatably provided in the rotating tub, wherein the pulsator is rotatably coupled with a first part rotatably provided at a lower portion of the rotating tub and about an axis perpendicular to the first part;

a coupler including a coupling groove body formed in a cylindrical shape at a center of an upper surface of the first part;

one or more coupling grooves recessed from a bottom of the coupling groove body;

a second part including a coupling protrusion body formed at a lower end of the second part to correspond to the coupling groove body;

and a discharge hole provided in the coupler to discharge foreign substances and water inside the pulsator through the coupler.

13. The washing machine of claim 12, wherein the discharge hole includes:

a first discharge hole formed in at least a portion of the first part, and a second discharge hole formed in at least a portion of the second part.

14. The washing machine of claim 13, wherein the first discharge hole and the second discharge hole are positioned to correspond to each other.

15. The washing machine of claim 13, wherein a plurality of the first discharge hole and a plurality of the second discharge hole are positioned to correspond to each other.

16. The washing machine of claim 13, wherein:

the discharge hole further includes a discharge flow path formed to discharge water and foreign substances inside the pulsator, and the first discharge hole and the second discharge hole are positioned on the discharge flow path.

* * * * *